US006629563B2

(12) United States Patent
Doane

(10) Patent No.: US 6,629,563 B2
(45) Date of Patent: Oct. 7, 2003

(54) PACKER RELEASING SYSTEM

(75) Inventor: James C. Doane, Friendswood, TX (US)

(73) Assignee: Baker Hughes Incorporated, Houston, TX (US)

( * ) Notice: Subject to any disclaimer, the term of this patent is extended or adjusted under 35 U.S.C. 154(b) by 43 days.

(21) Appl. No.: 09/855,357

(22) Filed: May 15, 2001

(65) Prior Publication Data

US 2002/0170710 A1 Nov. 21, 2002

(51) Int. Cl.[7] ..... E21B 23/06

(52) U.S. Cl. ..... 166/125; 166/120; 166/182; 166/242.6

(58) Field of Search ..... 166/120, 123, 166/125, 181, 182, 240, 242.6

(56) References Cited

U.S. PATENT DOCUMENTS

| | | | | |
|---|---|---|---|---|
| 3,311,171 A | | 3/1967 | Castro | |
| 3,361,207 A | | 1/1968 | Chenoweth | |
| 3,976,133 A | | 8/1976 | Allen | |
| 4,216,827 A | | 8/1980 | Crowe | |
| 4,393,929 A | * | 7/1983 | Akkerman | 166/134 |
| 4,436,150 A | | 3/1984 | Barker | |
| 4,518,037 A | | 5/1985 | Youngblood et al. | |
| 4,565,247 A | | 1/1986 | Tapp et al. | |
| 4,664,188 A | | 5/1987 | Zunkel et al. | |
| 4,967,844 A | * | 11/1990 | Brooks et al. | 166/381 |
| 5,333,685 A | | 8/1994 | Gilbert | |
| 5,718,291 A | | 2/1998 | Lorgen et al. | |
| 5,727,632 A | * | 3/1998 | Richards | 166/387 |
| 5,787,982 A | | 8/1998 | Bakke | |
| 5,826,652 A | | 10/1998 | Tapp | 166/120 |
| 5,941,306 A | | 8/1999 | Quinn | 166/120 |

FOREIGN PATENT DOCUMENTS

| | | |
|---|---|---|
| EP | 216527 | 4/1987 |

* cited by examiner

*Primary Examiner*—David Bagnell
*Assistant Examiner*—Zakiya Walker
(74) *Attorney, Agent, or Firm*—Steve Rosenblatt

(57) ABSTRACT

In a release system for a packer the release ring is minimally exposed in the wellbore and is actuated by a release tool, which comprises a collet and cone with a relative movement feature. In the preferred embodiment, the release ring has alternating cuts and a built in radially outward bias. The ring is held in locked position by bands, which are broken by the action of the releasing tool.

40 Claims, 7 Drawing Sheets

PACKER RELEASING SYSTEM

FIELD OF THE INVENTION

The field of this invention is a releasing system for downhole packers and more particularly, a system where the release mechanism is protected from accidental release and damage from flowing fluids.

BACKGROUND OF THE INVENTION

In the past, downhole packers were released in three different ways. Dogs were unsupported to let the body be extended for release. Collets became unsupported to have the same effect. Finally, the packer could be cut downhole to allow release. FIGS. 1*a*–1*c* illustrate a prior art mechanically set packer with a collet release system. A setting tool (not shown) pushes down on setting sleeve 10 while pulling up on the top sub 12 of mandrel 14. The setting sleeve 10 pushes down on the sealing elements 16, the upper cone 18 and the slips 20, while the mandrel 14, through collets 22, pulls up on the lower cone 24. The set position is held by body lock ring 26, which works like a ratchet to keep the set packer from relaxing. As seen in FIGS. 1*c* and 2, a support sleeve 28 is held on to the collets 22 by shear pins 30. In the position shown in FIG. 1*c* the support sleeve transmits the upward pull force from the top sub 12 to the lower cone 24 during the setting procedure. To release the packer, a release tool (not shown) is run downhole to engage the support sleeve 28 and pick it up so as to break shear pins 30 and to undermine the contact between the collets 22 and bottom sub 32 (see FIG. 3). The releasing tool brings up the support sleeve 28 against the mandrel 14 to allow the slips 20 to be undermined as the upper cone 18 is pulled out from under them. In a similar manner, the elements 16 are allowed to relax.

In a similar manner, the prior art design of FIGS. 4 and 5 operated to allow the packer to set and, later, to release, when a release tool (not shown) moved up release sleeve 34 undermining the segmented dogs 36 for a release from the bottom sub 38. These structures were also used with hydraulically set packers.

The potential problem with these designs is the exposed placement of the support sleeve 28 or the release sleeve 34. Lowing well fluids can cause damage due to erosion or corrosion. Additionally, tools are frequently run through such packers to actuate other devices below the packer. These tools could, inadvertently, engage the support sleeve 28 or the release sleeve 34 and trigger a release of the packer. This problem could be avoided with another known design which requires the packer to be cut loose after being set downhole. This technique is complicated and requires very experienced personnel to perform the operation. This technique also generates cuttings which can be left in the well and the packer is destroyed in the process, preventing reuse.

The present invention presents a unique mechanism for release which overcomes the drawbacks of the prior art as described above. The release mechanism is minimally exposed to the wellbore to give it protection from well fluid attack and accidental release from contact by other tools. Additionally, the packer is simply released and can be reused. These and other advantages of the present invention will be more readily understood from a review of the description of the preferred embodiment, which appears below. Other known packer release designs are illustrated in U.S. Pat. Nos.: 3,311,171; 3,361,207; 3,976,133; 4,216,827; 4,436,150; 4,518,037; 4,565,247; 4,664,188; 5,333,685; 5,718,291; and 5,787,982.

SUMMARY OF THE INVENTION

A release system for a packer is disclosed. The release ring is minimally exposed in the wellbore and is actuated by a release tool, which comprises a collet and cone with a relative movement feature. In the preferred embodiment, the release ring has alternating cuts and a built in radially outward bias. The ring is held in locked position by bands, which are broken by the action of the releasing tool.

DETAILED DESCRIPTION OF THE PREFERRED EMBODIMENT

Figure 1A:
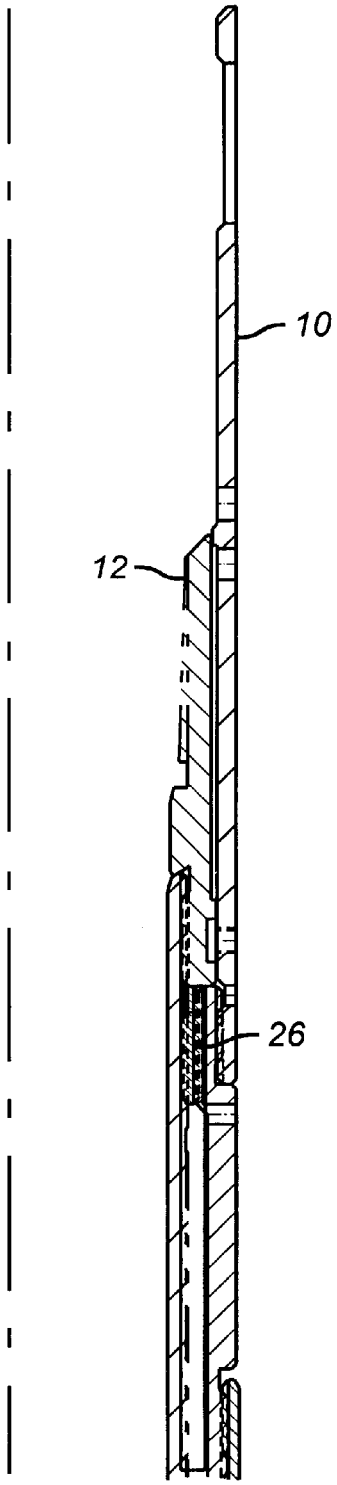
(PRIOR ART) FIG. 1a
FIGS. 1*a*–1*c* are a sectional elevation of a prior art tool using collet release, shown in the run in position.
Figure 1B:
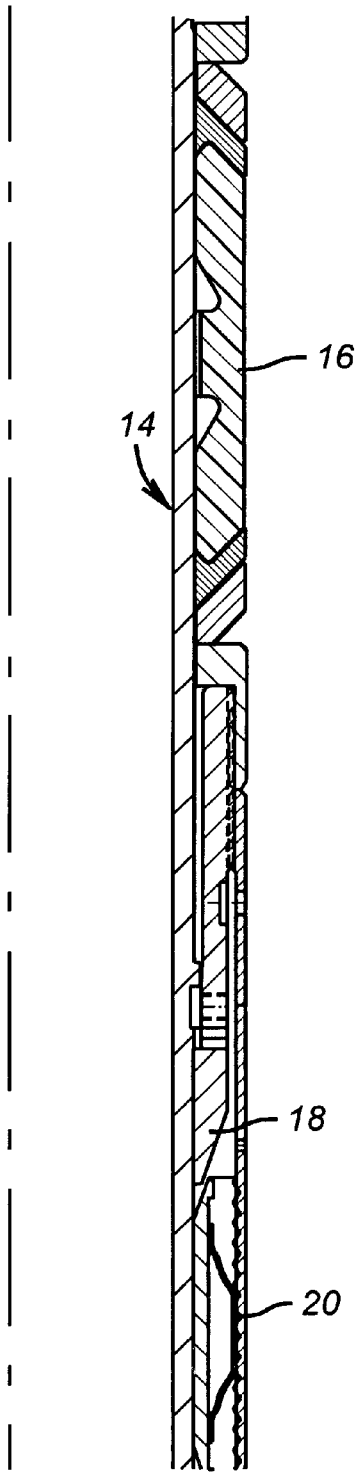
(PRIOR ART) FIG. 1b
Figure 1C:
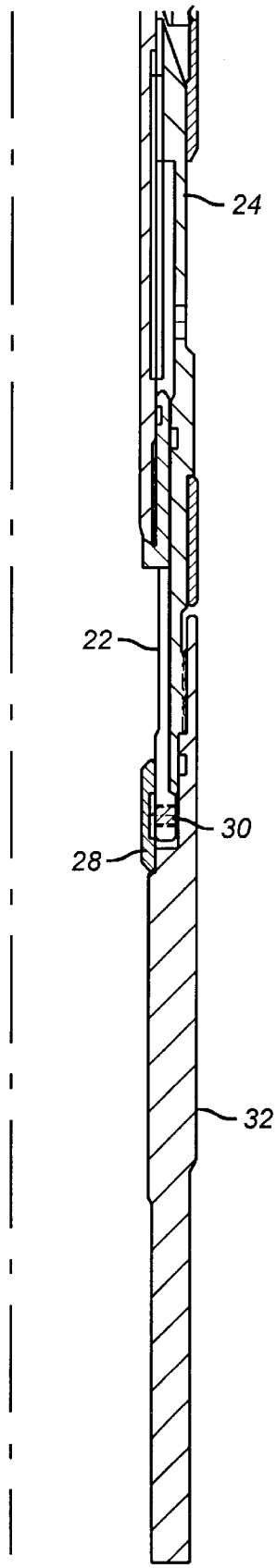
(PRIOR ART) FIG. 1c
Figure 2:
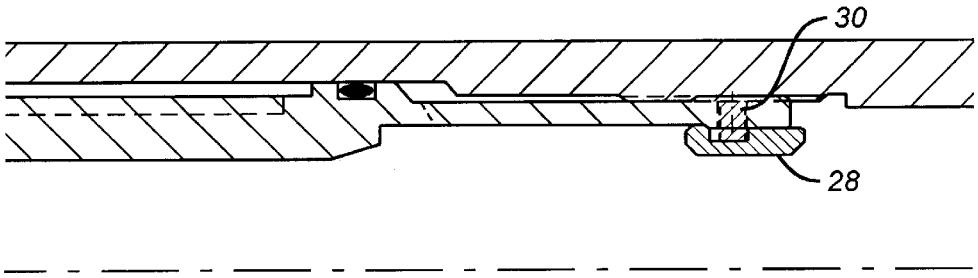
(PRIOR ART) FIG. 2
FIG. 2 is a detailed view of the collet release system shown in prior art FIG. 1*c,* shown it the set position for the packer.
Figure 3:
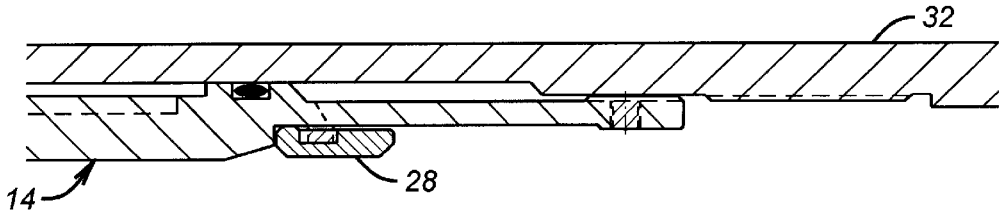
(PRIOR ART) FIG. 3
FIG. 3 is the view of the prior art tool shown in FIG. 2, but shown in the released position.
Figure 4:
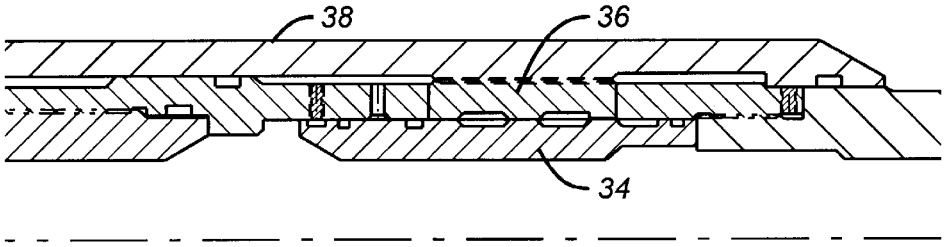
(PRIOR ART) FIG. 4
FIG. 4 is an alternative prior art design of a releasing assembly, shown in the set position.
Figure 5:
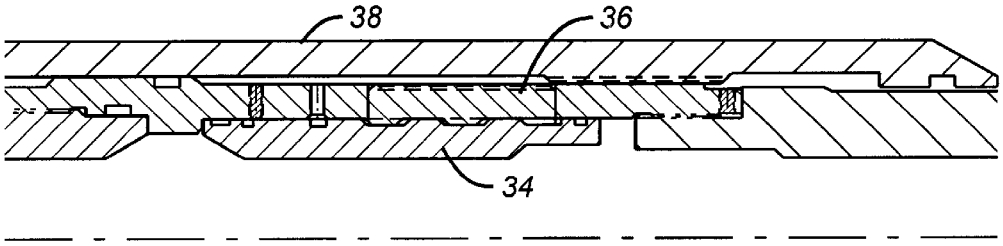
(PRIOR ART) FIG. 5
FIG. 5 is the view of FIG. 4 shown in the released position.
Figure 6:
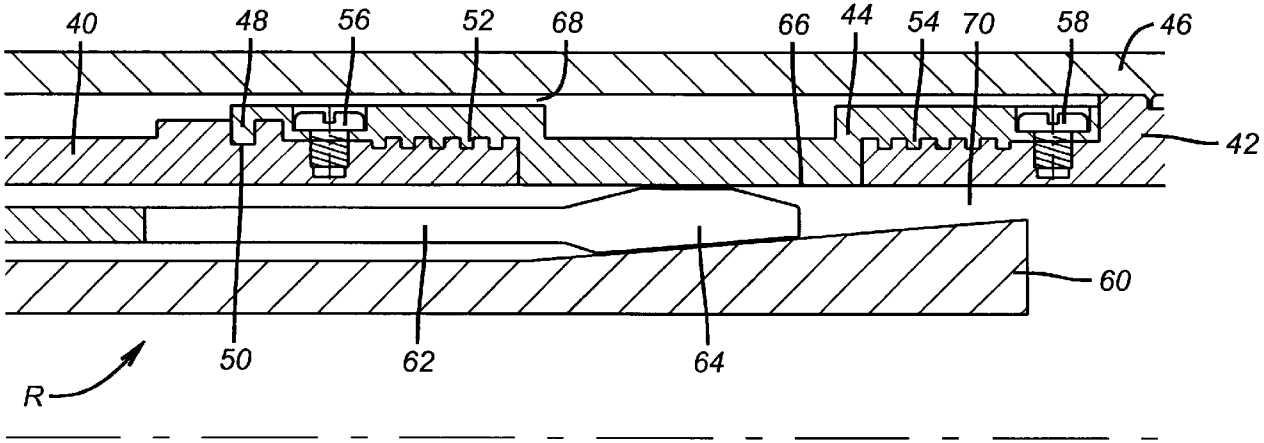
FIG. 6 is one embodiment of the present invention, shown in section, just prior to release with the releasing tool.

In a first embodiment of the invention, shown in FIG. 6, the pickup force to set the packer is transmitted from sleeve 40 to sleeve 42 through release ring 44. It should be noted that FIG. 6 illustrates the same area of the packer as FIGS. 2-5 but it represents one embodiment of the present invention to replace those prior art assemblies. Ultimately, sleeve 42 is connected to bottom sub 46 in an area off the right side of FIG. 6. Bottom sub 46 exerts an upward force on the lower cone to help set the slips and the element in the manner described for the prior art devices. What is different is how the setting force is transmitted and how the set is later released. In FIG. 6, the release ring is made of independent segments each having a tab 48, which extends into groove 50 of sleeve 40. A matching tooth or serration or other engagement pattern 52 helps retain the release ring 44 to the sleeve 40. Similarly, a similar structure 54 helps retain the sleeve 42 to the release ring 44. Initially, bolts 56 hold sleeve 40 to release ring 44 and bolts 58 retain the release ring 44 to sleeve 42. In FIG. 6, the retrieving tool is in position but has not yet been actuated. The retrieving tool R has a movable cone 60 adjacent a series of collets 62. When the retrieving tool R is actuated, the cone 60 moves relatively to the collets 62 pushing the collet heads 64 against surface 66 of release ring 44. There is a clearance space 68, which closes up as the release ring 44 has its segments pushed outwardly.

Figure 7:
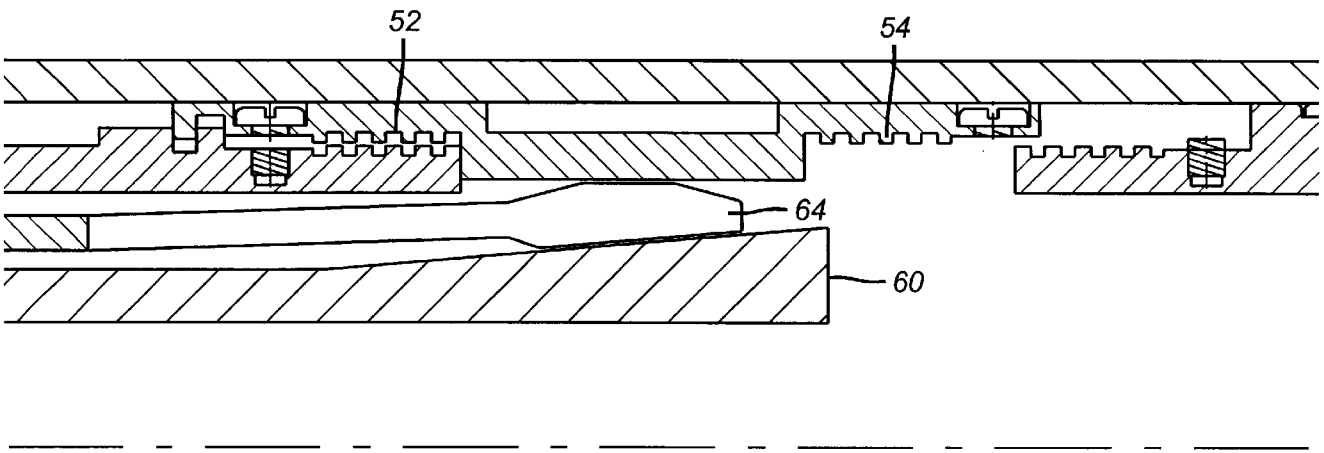
FIG. 7 is the view of FIG. 6 in the released position.

As shown in FIG. 7, actuation of the releasing tool R disengages the engagement patterns 52 and 54 but tab 48 is still in groove 50. Because the tab 48 is still engaged in groove 50, the segments that make up the release ring 44 remain connected to sleeve 40 and do not fall to the bottom of the wellbore. The release of the engagement patterns 52 and 54 allows the packer to be stretched out and retrieved in the known manner, using the retrieval tool R. Those skilled in the art will appreciate that each segment of release ring 44 has two bolts 56 and 58 to initially secure the engagement patterns 52 and 54 which are on it, respectively to sleeves 40 and 42. As shown in FIG. 6, surface 66 is flush in the passage 70 leaving it less likely to be actuated by tools going further downhole to operate other equipment. The limited exposed area of surface 66 further reduces the potential harmful effects from erosion or corrosion from passing well fluids. The engagement patterns 52 and 54 are completely out of the main flowpath. Additional seals can be optionally added to fully isolate the engagement patterns 52 and 54 from the moving well fluids. Once the packer is removed, it can be redressed for further use by putting the components back together as shown in FIG. 6.

Figure 8:
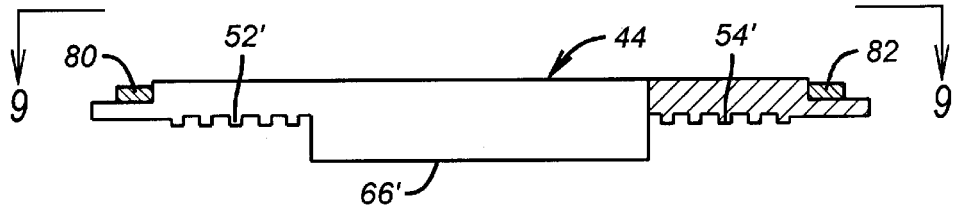
FIG. 8 is a section view of the release ring of the preferred embodiment of the invention.
Figure 9:
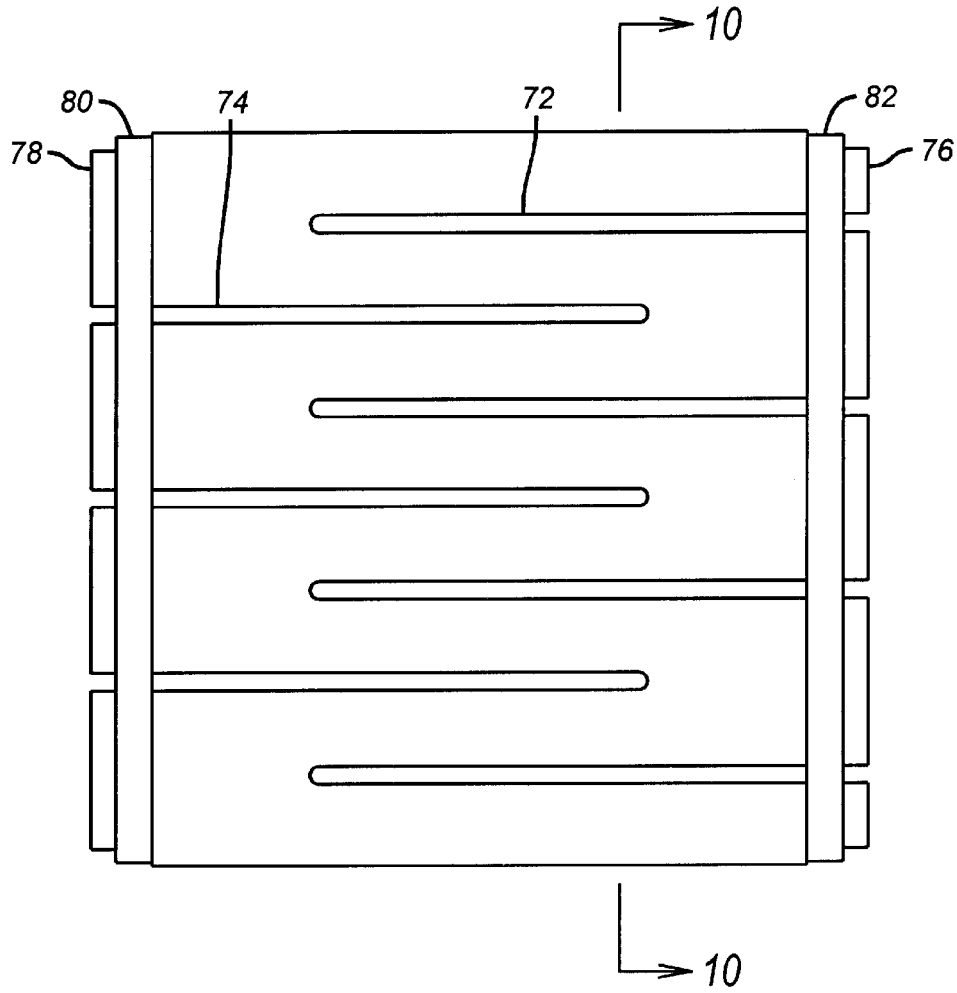
FIG. 9 is a view along lines 9—9 of FIG. 8.
Figure 10:
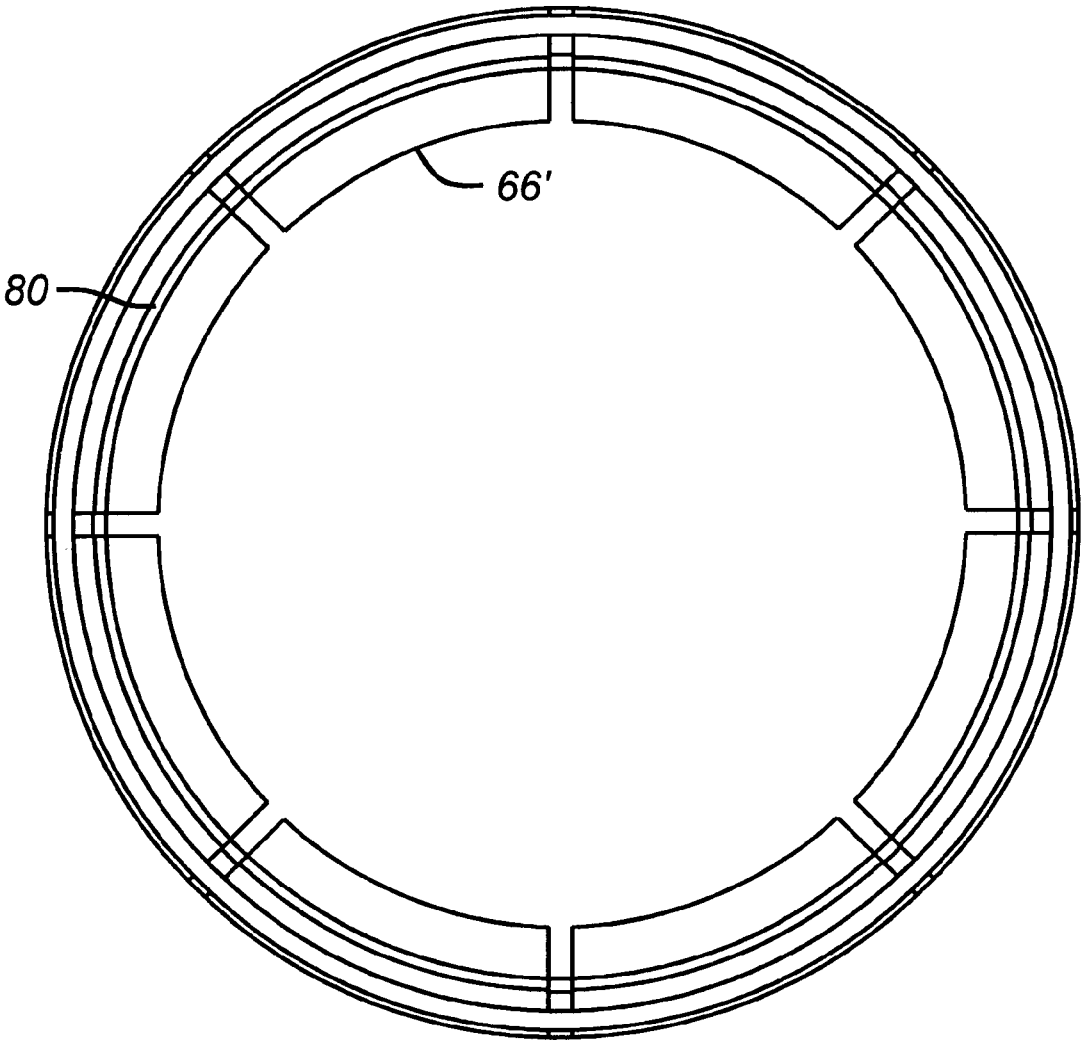
FIG. 10 is a view along lines 10—10 of FIG. 9.

The preferred embodiment is shown in FIGS. 8–10. In this version the release ring 44' takes the place of the segments that made up release ring 44. Engagement patterns 52' and 54' are still used with the release ring 44'. Rather than being segments, release ring 44' is a cylinder having alternating longitudinal notches 72 and 74 which begin, respectively, at opposite ends 76 and 78 of release ring 44'. An outward radial bias is built into release ring 44' toward the clearance space 68 (see FIG. 6), when release ring 44' is used in lieu of the segments that make up release ring 44. Overlaying the release ring 44' are bands 80 and 82 to urge radial inward movement against a spreading force by the retrieval tool R against surface 66'. The use of the bands 80 and 82 allows tab 48 and groove 50, used of segments that made up release ring 44 to be eliminated in the preferred design of release ring 44'. In other respects, the operation of the two embodiments of the invention are the same.

Those skilled in the art will appreciate that both embodiments of the invention described above present a minimal area in the passage 70 for the release mechanism. The flush mounting reduces the chance of an accidental release and minimizes the erosive and corrosive effects of flowing fluids. The size of the passage 70 can be maximized. The engagement patterns, such as 52' and 54', can be isolated from fluids flowing through passage 70. Minor impingements on to surface 66' are unlikely to actuate a release. Use of the flush mounted surface 66' makes it simpler to release, when that operation is desired, than even the design shown in FIGS. 6 and 7 and certainly release is easier than the prior art techniques illustrated in FIGS. 2–5. Surface 66' can also be slightly recessed. This makes it easier to properly locate the releasing tool R.

The above description of the preferred embodiment is merely illustrative of the optimal way of practicing the invention and various modifications in form, size, material or placement of the components can be made within the scope of the invention defined by the claims below.

I claim:

1. A release mechanism for a downhole packer, comprising:

a mandrel, having a passage therethrough;

a setting assembly selectively engageable by one of a mechanical mechanism and a hydraulic mechanism to actuate a sealing element and a slip upon relative movement between said mandrel and said setting assembly;

a lock to selectively hold said sealing element and said slip when actuated;

said mandrel resisting an opposed force on said setting assembly through a first sleeve selectively engageable to a second sleeve with a releasing ring, said releasing ring selectively disengaging said first and said second sleeves upon being radially displaced.

2. The mechanism of claim 1, wherein:

said releasing ring is disposed at least in part behind said first and second sleeves.

3. The mechanism of claim 2, wherein:

said releasing ring has an actuation surface exposed to said passage in said mandrel between said first and said second sleeves.

4. The mechanism of claim 3, wherein:

said actuation surface is disposed flush with respect to at least one of said first and said second sleeves.

5. The mechanism of claim 3, wherein:

said actuation surface is disposed in a recessed manner with respect to said passage and at least one of said first and said second sleeves.

6. The mechanism of claim 3, wherein:

said releasing ring is moveable outwardly by a releasing tool inserted into said passage, said releasing tool radially displacing said releasing ring until it is no longer engaged to said first and said second sleeves.

7. The mechanism of claim 6, wherein:

said releasing tool further comprises an inclined surface and at least one collet displaceable radially into said releasing ring due to relative longitudinal movement between said collet and said inclined surface.

8. The mechanism of claim 2, further comprising:

a mating engagement pattern on said releasing ring to engage a mating engagement pattern on at least one of said first and said second sleeves to prevent relative longitudinal movement therebetween, when said mating engagement patterns are selectively engaged.

9. The mechanism of claim 8, wherein said mating engagement pattern further comprises:

an upper and a lower engagement pattern near opposed ends of said releasing ring respectively selectively engageable with said mating engagement pattern on at least one of said first and said second sleeves.

10. The mechanism of claim 9, wherein:

said releasing ring is a one piece cylindrical shape further comprising a plurality of notches and is so configured so as to posses a radial bias away from said first and said second sleeves when fitted against them, said releasing ring further comprising a retainer to selectively overcome said radial bias to hold said first and said second sleeves to said releasing ring through said mating engagement patterns.

11. The mechanism of claim 10, further comprising:

a clearance space on the opposite side of said releasing ring from said passage to allow said releasing ring to be radially displaced from said passage into said clearance space to disengage said engagement patterns on said releasing ring from the respective mating engagement pattern on at least one of said first and second sleeves.

12. The mechanism of claim 11, wherein:

said retainer is flexibly expanded in response to a force moving said releasing ring radially into said clearance space, said retainer biasing said releasing ring toward said passage upon removal of a radially outward force on said releasing ring.

13. The mechanism of claim 12, wherein:

said releasing ring is moveable outwardly by a releasing tool inserted into said passage, said releasing tool radially displacing said releasing ring until it is no longer engaged to said first and said second sleeves.

14. The mechanism of claim 13, wherein:

said releasing tool further comprises an inclined surface and at least one collet displaceable radially into said releasing ring due to relative longitudinal movement between said collet and said inclined surface.

15. The mechanism of claim 9, wherein:

said releasing ring comprises a plurality of distinct components initially held to said first and said second sleeves by at least one removable member.

16. The mechanism of claim 15, comprising:

a clearance space on the opposite side of said releasing ring from said passage to allow said releasing ring to be radially displaced from said passage into said clearance space, thereby disabling said removable member, and disengaging said engagement patterns on said releasing ring from the respective mating engagement pattern on at least one of said first and second sleeves.

17. The mechanism of claim 16, further comprising:

a tab on said releasing ring components which remains engaged in a groove in one of said first and second sleeves, despite movement of said components into said clearance space.

18. A packer release mechanism for slips and a sealing element for a packer set by one of a hydraulic mechanism and a mechanical mechanism, comprising:

a mandrel defining a passage therethrough and further comprising a first and a second sleeve selectively retained to each other by a releasing ring which is radially displaceable.

19. The mechanism of claim 18, wherein:

said releasing ring is disposed at least in part behind said first and second sleeves.

20. The mechanism of claim 19, wherein:

said release ring has an actuation surface exposed to said passage in said mandrel between said first and said second sleeves; and a mating engagement pattern on said releasing ring to engage a mating engagement pattern on at least one of said first and said second sleeves to prevent relative longitudinal movement therebetween, when said mating engagement patterns are selectively engaged.

21. The mechanism of claim 20, wherein said mating engagement pattern further comprises:

an upper and a lower engagement pattern near opposed ends of said releasing ring respectively selectively engageable with mating engagement pattern on at least one of said first and said second sleeves; and said releasing ring is a one piece cylindrical shape further comprising a plurality of notches and is so configured so as to posses a radial bias away from said first and said second sleeves when fitted against them, said releasing ring further comprising a retainer to selectively overcome said radial bias to hold said first and said second sleeves to said releasing ring through said mating engagement patterns.

22. The mechanism of claim 21, wherein:

a clearance space on the opposite side of said releasing ring from said passage to allow said releasing ring to be radially displaced from said passage into said clearance space to disengage said engagement patterns on said releasing ring from the respective mating engagement pattern on at least one of said first and second sleeves; and said retainer is flexibly expanded in response to a force moving said releasing ring radially into said clearance space, said retainer biasing said releasing ring toward said passage upon removal of a radially outward force on said releasing ring.

23. The mechanism of claim 18, wherein:

said releasing ring is moveable outwardly by a releasing tool inserted into said passage, said releasing tool radially displacing said releasing ring until it no longer retains said first and said second sleeves; and said releasing tool further comprises an inclined surface and at least one collet displaceable radially into said releasing ring due to relative longitudinal movement between said collet and said inclined surface.

24. A release mechanism for a downhole tool, comprising:

a first and second tubular members, mounted in a body having a passage therethrough, each having a longitudinal axis and a passage therethrough;

a release member operably connected to said first and second tubular members and exposed in said passage in said body to keep said first and second tubular members in a locked position until said release member is moved radially by direct contact from said passage in a direction away from said longitudinal axis.

25. A release mechanism for a downhole tool, comprising:

a first and second tubular members, mounted in a body having a passage therethrough, each having a longitudinal axis and a passage therethrough;

a release member operably connected to said first and second tubular members and exposed in said passage in said body to keep said first and second tubular members in a locked position until said release member is moved radially by direct contact from said passage in said body with respect to at least one said longitudinal axis;

said release member comprises a releasing ring, which is disposed at least in part behind said first and second tubular members.

26. The mechanism of claim 25, wherein:

said releasing ring has an actuation surface exposed to said passage in said body between said first and said second members.

27. The mechanism of claim 26, wherein:

said actuation surface is disposed in a recessed manner with respect to said passage in said members and at least one of said first and said second members.

28. The mechanism of claim 25, further comprising:

a mating engagement pattern on said releasing ring to engage a mating engagement pattern on at least one of said first and said second members to prevent relative longitudinal movement therebetween, when said mating engagement patterns are selectively engaged.

29. The mechanism of claim 28, wherein said mating engagement pattern further comprises:

an upper and a lower engagement pattern near opposed ends of said releasing ring respectively selectively engageable with said mating engagement pattern on at least one of said first and said second members.

30. The mechanism of claim 29, wherein:

said releasing ring is a one piece cylindrical shape further comprising a plurality of notches and is so configured so as to posses a radial bias away from said first and said second members when fitted against them, said releasing ring further comprising a retainer to selectively overcome said radial bias to hold said first and said second members to said releasing ring through said mating engagement patterns.

31. The mechanism of claim 30, further comprising:

a clearance space on the opposite side of said releasing ring from said passage in said members to allow said releasing ring to be radially displaced from said passage into said clearance space to disengage said engagement patterns on said releasing ring from the respective mating engagement pattern on at least one of said first and second sleeves.

32. The mechanism of claim 31, wherein:

said retainer is flexibly expanded in response to a force moving said releasing ring radially into said clearance space, said retainer biasing said releasing ring toward said passage upon removal of a radially outward force on said releasing ring.

33. A release mechanism for a downhole tool, comprising:

a first and second tubular members, mounted in a body, each having a longitudinal axis and a passage therethrough;

a release member operably connected to said first and second tubular members to keep said first and second tubular members in a locked position until said release member is moved radially with respect to at least one said longitudinal axis;

said release member comprises a releasing ring, which is disposed at least in part behind said first and second tubular members;

said releasing ring has an actuation surface between said first and said second members;

said actuation surface is disposed flush with respect to at least one of said first and said second members.

34. A release mechanism for a downhole tool, comprising:

a first and second tubular members, mounted in a body, each having a longitudinal axis and a passage therethrough;

a release member operably connected to said first and second tubular members to keep said first and second tubular members in a locked position until said release member is moved radially with respect to at least one said longitudinal axis;

said release member comprises a releasing ring, which is disposed at least in part behind said first and second tubular members;

a mating engagement pattern on said releasing ring to engage a mating engagement pattern on at least one of said first and said second members to prevent relative longitudinal movement therebetween, when said mating engagement patterns are selectively engaged;

an upper and a lower engagement pattern near opposed ends of said releasing ring respectively selectively engageable with said mating engagement pattern on at least one of said first and said second members;

said releasing ring comprises a plurality of distinct components initially held to said first and said second members by at least one removable member.

35. The mechanism of claim 34, further comprising:

a clearance space on the opposite side of said releasing ring from said passage in said members to allow said releasing ring to be radially displaced from said passage into said clearance space, thereby disabling said removable member, and disengaging said engagement patterns on said releasing ring from the respective mating engagement pattern on at least one of said first and second sleeves.

36. The mechanism of claim 35, further comprising:

a tab on said releasing ring components that remains engaged in a groove in one of said first and second members, despite movement of said components into said clearance space.

37. A release mechanism for a downhole tool, comprising:

a first and second tubular members, mounted in a body, each having a longitudinal axis and a passage therethrough;

a release member operably connected to said first and second tubular members to keep said first and second tubular members in a locked position until said release member is moved radially with respect to at least one said longitudinal axis;

said release member comprises a releasing ring, which is disposed at least in part behind said first and second tubular members;

said releasing ring has an actuation surface between said first and said second members;

said releasing ring is moveable outwardly by a releasing tool inserted into said passage, said releasing tool radially displacing said releasing ring until it no longer locks said first and said second members.

38. The mechanism of claim 37, wherein:

said releasing tool further comprises an inclined surface and at least one collet displaceable radially into said releasing ring due to relative longitudinal movement between said collet and said inclined surface.

39. A release mechanism for a downhole tool, comprising:

a first and second tubular members, mounted in a body having a passage therein, each having a longitudinal axis and a passage therethrough;

a release member operably connected to said first and second tubular members to keep said first and second tubular members in a locked position until said release member is moved radially with respect to at least one said longitudinal axis;

said release member comprises a releasing ring, which is disposed at least in part behind said first and second tubular members;

a mating engagement pattern on said releasing ring to engage a mating engagement pattern on at least one of said first and said second members to prevent relative longitudinal movement therebetween, when said mating engagement patterns are selectively engaged;

an upper and a lower engagement pattern near opposed ends of said releasing ring respectively selectively engageable with said mating engagement pattern on at least one of said first and said second members;

said releasing ring is a one piece cylindrical shape further comprising a plurality of notches and is so configured so as to posses a radial bias away from said first and said second members when fitted against them, said releasing ring further comprising a retainer to selectively overcome said radial bias to hold said first and said second members to said releasing ring through said mating engagement patterns;

a clearance space on the opposite side of said releasing ring from said passage in said members to allow said releasing ring to be radially displaced from said passage in said members into said clearance space to disengage said engagement patterns on said releasing ring from the respective mating engagement pattern on at least one of said first and second sleeves;

said retainer is flexibly expanded in response to a force moving said releasing ring radially into said clearance space, said retainer biasing said releasing ring toward said passage upon removal of a radially outward force on said releasing ring;

said releasing ring is moveable outwardly by a releasing tool inserted into said passage in said body, said releasing tool radially displacing said releasing ring until it no longer locks said first and said second sleeves.

40. The mechanism of claim 39, wherein:

said releasing tool further comprises an inclined surface and at least one collet displaceable radially into said releasing ring due to relative longitudinal movement between said collet and said inclined surface.

* * * * *